US006088993A

United States Patent [19]

Irace

[11] Patent Number: 6,088,993

[45] Date of Patent: Jul. 18, 2000

[54] CLOSURE SYSTEM

[76] Inventor: Francisco D. Irace, 6225 SW. Kendale Lake Cir. No. D-152, Miami, Fla. 33183

[21] Appl. No.: 09/245,463

[22] Filed: Feb. 5, 1999

[51] Int. Cl.[7] ..... E06B 3/72

[52] U.S. Cl. ..... 52/800.13; 52/800.18

[58] Field of Search ..... 52/800.18, 800.13, 52/800.12

[56] References Cited

U.S. PATENT DOCUMENTS 2,457,129 12/1948 Collings ..... 52/800.13 X 4,640,053 2/1987 Lew ..... 52/800.13 X 5,743,057 4/1998 Martin ..... 52/800.13 X

*Primary Examiner*—Christopher T. Kent

*Attorney, Agent, or Firm*—J. Sanchelima

[57] ABSTRACT

A closure system for openings that includes upper and lower elongated support members that sandwich at least two panel members coplanarly disposed. The elongated support members are cut to the desired size depending on the opening and the panels separated accordingly. The panel members' edges that include channels adjacent thereto are mounted at the ends. The surface opposite to the surface where the channel is located includes a removably mounted ornamentary cover. A slidable hinge assembly is mounted on the channel that permits a user to adjust its location.

8 Claims, 3 Drawing Sheets

CLOSURE SYSTEM

BACKGROUND OF THE INVENTION

1. Field of the Invention

The present invention relates to a closure system, and more particularly, to the type that can be readily built to any opening dimensions.

2. Description of the Related Art

Many types of closure systems devices exist today. Most of them fall within standard dimensions accepted by the industry. In the cabinet industry, however, it is difficult to harness the closure needs to these standards, specially when a user desires to efficiently use the space that is available. Additionally, mounting hinge assembly requires considerable pre-planning and the characteristics of the cabinets or other physical objects not infrequently require on-site modifications. The present invention provides a closure system that can be adapted to most situations.

SUMMARY OF THE INVENTION

It is one of the main objects of the present invention to provide a closure system that can be readily adjusted to be installed in openings of different dimensions.

It is another object of this invention to provide a closure system that permits a user to adjust the position of accessories, such as hinge assemblies, along a rail channel.

It is still another object of the present invention to provide a closure system that permits the use of replaceable covers.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
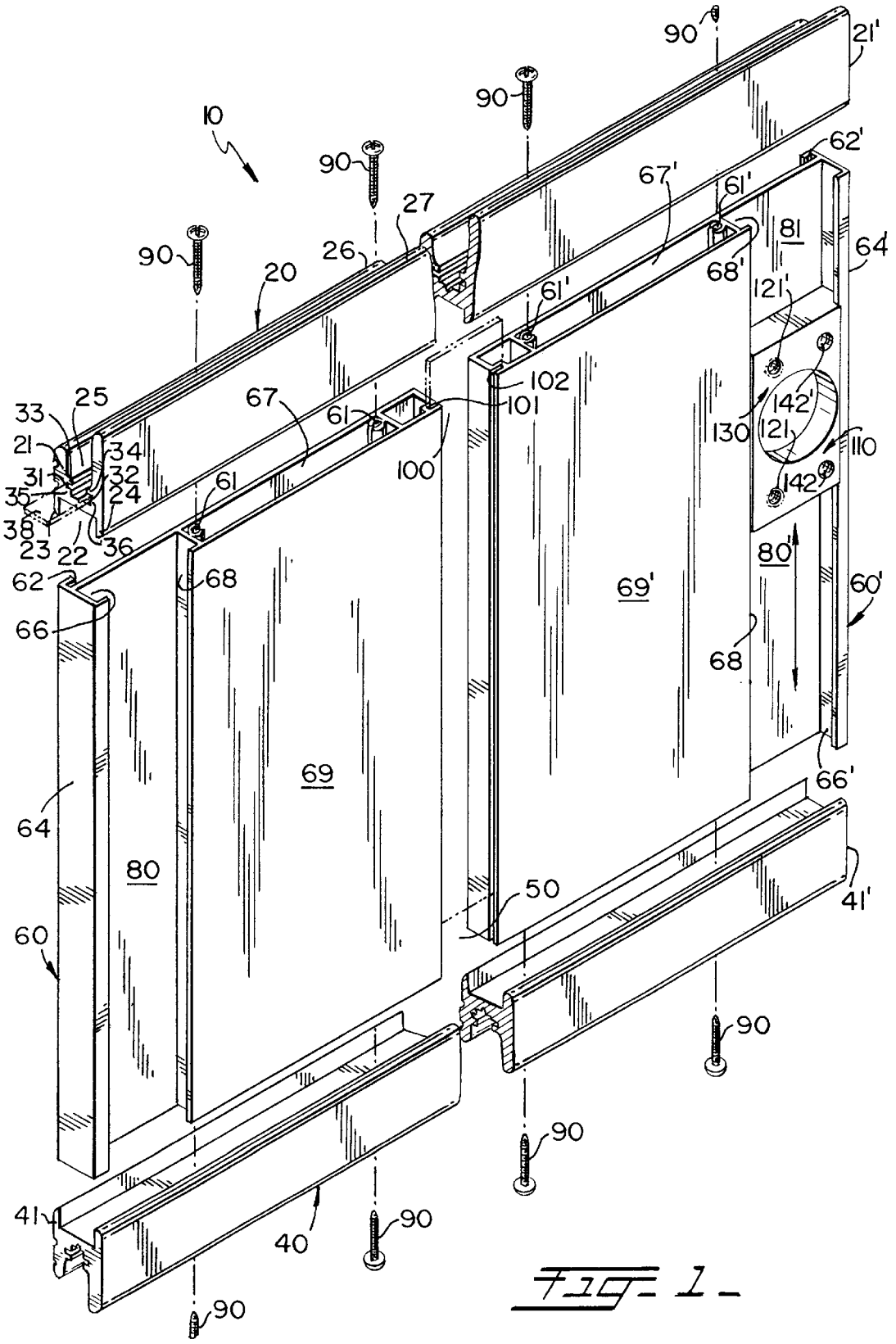
FIG. 1 represents an isometric view of a closure member with the upper and lower support members broken and separated from the panels.
Figure 2:
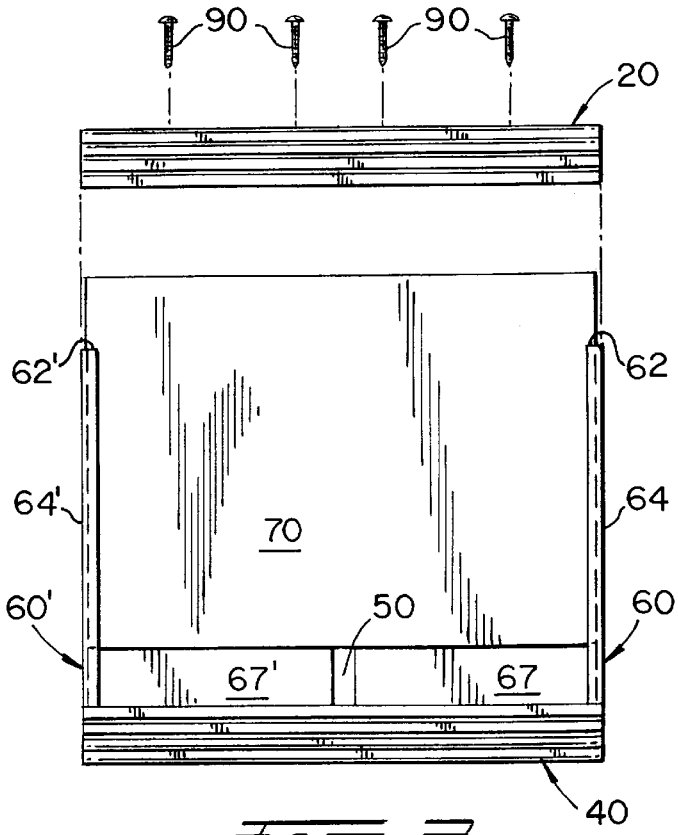
FIG. 2 shows a front view of the closure member represented in the previous figure with a cover sliding into position.

Referring now to the drawings, where the present invention is generally referred to with numeral 10, it can be observed that it basically includes upper and lower support members 20 and 40 that are mounted against the upper and lower edges, respectively, of identical panel members 60 and 60'. Panel member 60 and 60' are typically separated and are mounted adjacent to the ends 21, 21', 41, 41' of members 20 and 40, which in turn have cooperative dimensions to match the opening where closure system 10 is installed. Thus, the spacing 50 between panels 60 and 60' vary. Guiding slots 101 and 102 are designed to receive optional cover 70 (shown in FIG. 1) that has cooperative dimensions to cover spacing 50 if a user so desires.

Panels 60 and 60' include L-shape outer guide members 62 and 62' that extend longitudinally along one edge of end plates 64 and 64'. Outer guide members 62 and 62' receive inbetween cover sheet 100 that is typically esthetically enhanced with selected colors, design, and/or information. On the opposite (inner) surface, L-shape inner guide members 66 and 66' are designed to cooperate with flange members 68 and 68' to slidably receive accessories, such as hinge assembly 110, that can be adjustably positioned along tracks or channels 80 and 80'.

Figure 4:
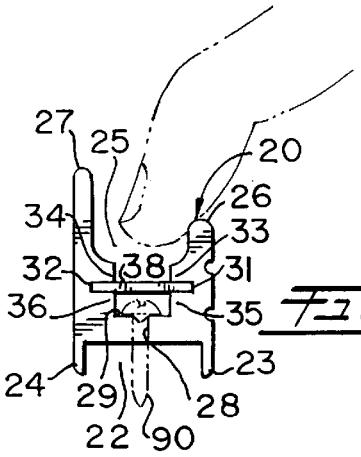
FIG. 4 is an end view of the upper (or lower) support member with a user's finger in phantom.
Figure 5A:
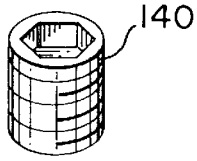
FIG. 5*a* is an isometric view of the fastening member for fixing the hinge assembly in a desired location.

Upper and lower support members 20 and 40 have two end views each as the one represented in FIG. 4. The bottom includes longitudinally extending legs 23 and 24 that extend at a parallel and spaced apart relationship with respect to each other to define channel 22. The width of channel 22 is sufficient to snugly receive end plates 64 and 64' and parallel plates 67; 69 and 67'; 69' inbetween.

The upper portion of member 20 (and 40) includes a longitudinal trough 25 defined by two parallel and spaced apart longitudinally extending ridge members 26 and 27 (one taller than the other one) as seen in FIGS. 1 and 4. Trough 25 has cooperative dimensions to act as a handle permitting a user to insert his/her fingers to pull closure 10. The bottom of trough 25 includes openings 28 through which fastening members 90 are passed to secure member 20 (and 40) to the upper (and lower) sides of panels 60 and 60'. Tubular fastener receiving members 61 and 61' are designed to receive fastening members 90. At a predetermined distance ( slightly larger than the length of the head of fastening member 90) above trough bottom 29 longitudinally extending slots 31 and 32 are positioned. Slots 31 and 32 are defined by longitudinally and inwardly extending flange members 33, 34, 35, and 36. Slots 31 and 32 cooperate to slidably receive cover 38 intended to cover fastening members 90 after installation.

Figure 3:
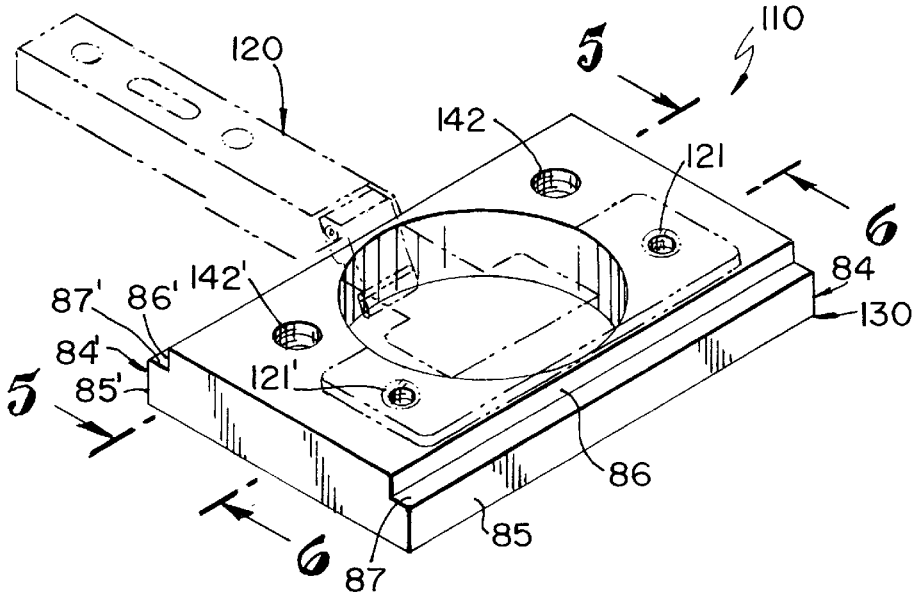
FIG. 3 illustrates an isometric view of the hinge assembly and the hinge in phantom.
Figure 5:
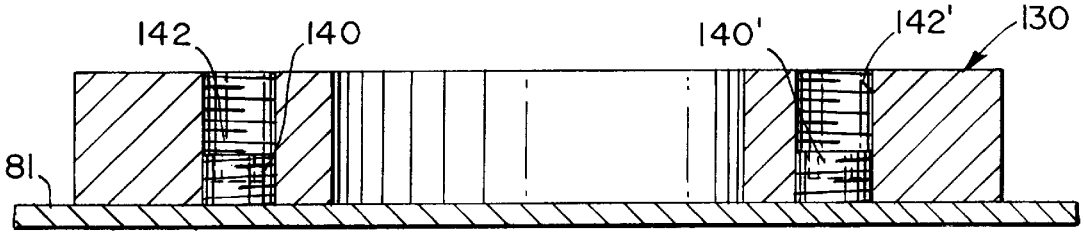
FIG. 5 is a cross-sectional view of the carrier assembly taken along line 5—5 in FIG. 3.

Hinge assembly 110 is best seen in FIGS. 1 and 3. Hinge assembly 110 includes spring loaded hinge member 120 in the preferred embodiment, typically used in the cabinet industry. Hinge member 120 is mounted to carrier assembly 130, that includes cooperative dimensions to slide along channels 80 and 80'. Carrier assembly 130 can be best seen in FIGS. 1; 3; 5 and 6. It can be seen from FIG. 3 that it has a substantially rectangular shape with two opposite stepped sides 84 and 84' with outer walls 85 and 85' and inner walls 86 and 86'. Step walls 87 and 87' are perpendicular to walls 85 and 85' and 86; 86', respectively. The separation between walls 85 and 85' is such that permits carrier 130 to snugly slide along channel 80 (or 80'). The surface of step walls 87 and 87' come in frictional abutment with the inner surfaces of L-shape inner guide members 66; 66' and flange members 68; 68'. Fastening member 140 has an outer thread and polygonal socket to facilitate its rotation with a compatible tool. Member 140 (140') is mounted to threaded opening 142 (142') protruding through the lower flat (larger) surface of carrier assembly 130 so that the end of member 140 comes on contact with channel bottom surface 81. By urging member 140 towards surface 81, step wall 87 (and 87') are pressed against the inner surfaces of L-shape inner guide member 66 (66') and flange member 68 (and 68') thus providing the necessary frictional force to keep carrier assembly 130 in a predetermined position along channel 80 (80').

Figure 6:
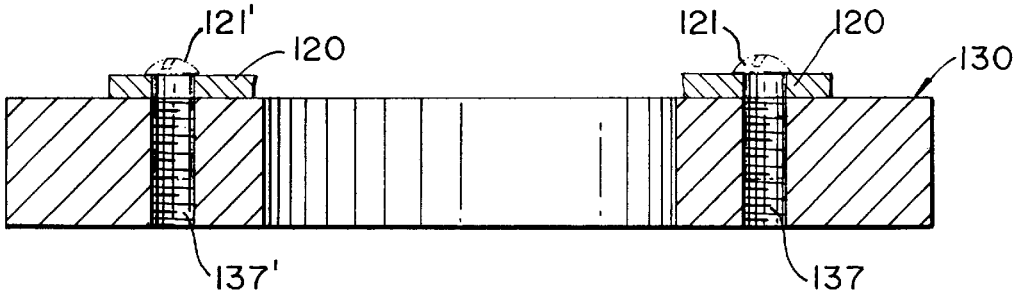
FIG. 6 is a cross-sectional view of the carrier assembly taken along line 6—6 in FIG. 3.

Hinge assembly 120 includes fastening members 121 and 121' that are mounted to openings 137 and 137' in carrier assembly 130, as it can be seen in FIGS. 3 and 6. In this manner, hinge assembly can be located at any one place along channel 80 (80').

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A closure system, comprising:

A) at least two panel members each having first and second surfaces and a substantially rectangular shape with first, second, third, and fourth edges, and including a first elongated channel defined on said first surface and adjacent to said first edge, said second and third edges being parallel to each other and perpendicular to said first edge, said panel members being disposed in a coplanar relationship with respect to each other, and said fourth edge is positioned opposite and parallel to said first edge, and the first edges of at least two panel members are positioned at the distal ends of said panel members;

B) first and second elongated support members disposed in a parallel and spaced apart relationship with respect to each other and mounted respectively, to said second and third edges of said panel members; and C) hinge means slidably mounted along one of said first elongated channels including at least one carrier that is cooperatively received within said first elongated channel and further including first fastening means for removably fixing said carrier at predetermined positions along said first elongated channel.

2. The closure system set forth in claim 1, further including:

D) a cover member having cooperative dimensions to be removably mounted on said second surface.

3. The closure system set forth in claim 2 wherein said first and second elongated support members include coextensive second elongated channels that cooperatively receive said second and third edges.

4. The closure system set forth in claim 3 wherein said first and second elongated members include transversaly extending through openings and further including second fastening means passing through said through openings for mounting said panel members to said first and second elongated support members.

5. The closure system set forth in claim 4 wherein said first edges includes end plate members with first guiding means for receiving said flat cover member.

6. The closure system set forth in claim 5 wherein said first elongated channel includes second guiding means for slidably receiving said hinge means including inwardly extending flanges that cooperate with said first fastening means to frictionally keep said hinge means at a predetermined position along said first elongated channel.

7. The closure system set forth in claim 6 wherein said first and second support members include a longitudinally extending trough opposite to said second elongated channel and further including third guiding means and an elongated cover receivable within said third guiding means so that said second fastening means are covered.

8. The closure system set forth in claim 7 wherein said trough includes cooperative dimension to permit a user to insert his/her fingers to pull said closure system.

* * * * *